US005625662A

United States Patent [19]

Toth et al.

[11] Patent Number: 5,625,662

[45] Date of Patent: Apr. 29, 1997

[54] MODULATING X-RAY TUBE CURRENT IN A CT SYSTEM

[75] Inventors: Thomas L. Toth, Brookfield; Mark K. Limkeman, New Berlin, both of Wis.

[73] Assignee: General Electric Company, Milwaukee, Wis.

[21] Appl. No.: 560,672

[22] Filed: Nov. 20, 1995

[51] Int. Cl.[6] ..... H05G 1/60

[52] U.S. Cl. ..... 378/16; 378/108; 378/109; 378/4

[58] Field of Search ..... 378/145, 146, 378/108, 109, 110, 4, 16, 901, 112

[56] References Cited

U.S. PATENT DOCUMENTS 5,228,070 7/1993 Mattson ..... 378/19

5,379,333 1/1995 Toth ..... 378/16

5,485,494 1/1996 Williams et al. ..... 378/145

*Primary Examiner*—Don Wong

*Attorney, Agent, or Firm*—John S. Beulick; John H. Pilarski

[57] ABSTRACT

The present invention, in one form, is an x-ray CT system that modulates x-ray tube current as a function of gantry angle and reconstruction algorithm weighting coefficients. View indexes are stored in a table, and during scanning, values are periodically read from this table to determine weighting coefficients. An algorithm is applied to the weighting coefficients to generate an x-ray tube modulating factor. This modulating factor is then applied to the x-ray tube current to generate modulated x-ray tube current.

17 Claims, 4 Drawing Sheets

MODULATING X-RAY TUBE CURRENT IN A CT SYSTEM

FIELD OF THE INVENTION

This invention relates generally to computed tomography (CT) imaging and more particularly, to reducing motion artifacts by modulating X-ray tube current.

BACKGROUND OF THE INVENTION

In at least one known CT system configuration, an x-ray source projects a fan-shaped beam which is collimated to lie within an X-Y plane of a Cartesian coordinate system and generally referred to as the "imaging plane". The x-ray beam passes through the object being imaged, such as a patient. The beam, after being attenuated by the object, impinges upon an array of radiation detectors. The intensity of the attenuated beam radiation received at the detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile.

In known third generation CT systems, the x-ray source and the detector array are rotated with a gantry within the imaging plane and around the object to be imaged so that the angle at which the x-ray beam intersects the object constantly changes. A group of x-ray attenuation measurements, i.e., projection data, from the detector array at one gantry angle is referred to as a "view". A "scan" of the object comprises a set of views made at different gantry angles during one revolution of the x-ray source and detector. In an axial scan, the projection data is processed to construct an image that corresponds to a two dimensional slice taken through the object. One method for reconstructing an image from a set of projection data is referred to in the art as the filtered backprojection technique. This process converts the attenuation measurements from a scan into integers called "CT numbers" or "Hounsfield units", which are used to control the brightness of a corresponding pixel on a cathode ray tube display.

To reduce the total scan time required for multiple slices, a "helical" scan may be performed. To perform a "helical" scan, the patient is moved while the data for the prescribed number of slices is acquired. Such a system generates a single helix from a one fan beam helical scan. The helix mapped out by the fan beam yields projection data from which images in each prescribed slice may be reconstructed. An image reconstruction algorithm which may be utilized in reconstructing an image from data obtained in a helical scan is described in U.S. patent application Ser. No. 08/436,176, filed May 9, 1995, and assigned to the present assignee.

Certain reconstruction process steps are known to produce noise structures in an image. For example, underscan weighting ("USW"), also known as peristaltic correction of CT projection data, is employed to reduce motion artifacts that results when patient anatomy moves during a 360 degree CT scan. Patient motion causes a discontinuity between the beginning and ending projections which typically produces low frequency streaks in the direction of the scan start angle, i.e., the initial relative angular position of the x-ray source and the subject.

In USW, since a 360 degree scan generates sufficient projection data to reconstruct two independent images of each scanned slice, two such independent images are generated. Specifically, over a small angle, e.g., 45 degrees, the data prior to backprojection is decreasingly weighted with a continuous cubic function so the image contribution of the projection data at the discontinuity is zero. Redundant data, i.e., opposing samples, are increasingly weighted so the contribution of the projection data opposite the discontinuity is assigned a weight of 2. USW thus softens the discontinuity and preserves the reconstruction requirement that the sum of the backprojection weights from every angle be equal.

However, USW has the undesirable effects of producing a noise pattern oriented in the direction of the scan start angle and exposing a patient to unnecessary radiation. The noise occurs because only one projection (N photons) is effectively backprojected in the USW direction, while two projections (2N photons) are used in the orthogonal direction. The projection noise in the USW direction will therefore be 1.414 times greater than in the orthogonal direction. This noise pattern is especially noticeable in large uniform regions such as the liver, and such noise complicates the diagnosis of low contrast lesions in this organ that are of vital interest in oncology patients.

Reconstruction algorithms for helical scanning also require the use of helical weighting ("HW") as a function of view angle. HW is similar to USW and the effect of HW on helical images noise is the substantially the same as USW. That is, with HW, projection noise will be 1.414 times greater in the maximum HW direction.

USW and HW also expose the patient to the same X-ray dose for every projection even though some of the projections contribute almost zero weight to the reconstruction. Even though some projections make substantially no contribution, the patient is exposed to an x-ray dose to collect that subsequently zero weighted data.

X-ray dose is typically controlled by the x-ray tube current ("mA") which flows in the x-ray tube. Traditionally, this current was fixed at a level which provided a constant dose during the entire scan. However, more recently, and to reduce patient dose, the x-ray tube current has been varied during the scan as a function of the projection angle, i.e., the relative angular position of the x-ray source and the subject being x-rayed. One such method is described, for example, in U.S. Pat. No. 5,379,333, entitled "Variable Dose Application By Modulation of X-Ray Tube Current During Scanning", which is assigned to the present assignee and incorporated herein, in its entirety, by reference.

Although varying, or modulating, x-ray tube current as a function of scan angle facilitates reducing patient dose, such variations do not take into account artifacts which may be later introduced due to weighting functions such as the weighting function employed in USW and HW. Of course, in addition to removing motion artifacts, it would be desirable to remove other artifacts from the image.

SUMMARY OF THE INVENTION

These and other objects may be attained in a system which, in one embodiment, varies the X-ray tube current (mA) and the resulting X-ray photon flux over the duration of the scan to better equalize the backprojected photon count. Specifically, in one embodiment, the x-ray tube current is varied, or modulated, as a function of view angle in accordance with the weighting to be applied to views during image reconstruction.

For example, where HW or USW is utilized in reconstruction, the x-ray tube current is modulated during scanning. The modulation is driven by the weighting function to better compensate image noise for the underscan weighting used during reconstruction. Specifically, x-ray tube current is modulated according to modulating factor ($F_i$) in accordance with the following:

$F_i = w_i/2.0$ for: $2 \cdot \min < w_i \leqq 2.0$, otherwise $F_i = \min$ where:

$F_i$ is the normalize view dependent mA adjustment factor;

i is the view angle index;

$w_i$ is the weighting coefficient, applied or pursuant to, for example, USW for a central ray in view$_i$ and where: $0 < w_i < 2.0$; and min=0.44 is the minimum desired mA adjustment factor.

By modulating x-ray tube current in accordance with the subsequent weighting to be applied to the data, a more isotropic noise structure is provided which improves the diagnostic quality of the image. In addition, patient dose is reduced for those projections which will ultimately be weighted to contribute less in the image reconstruction.

DETAILED DESCRIPTION OF THE DRAWINGS

Figure 1:
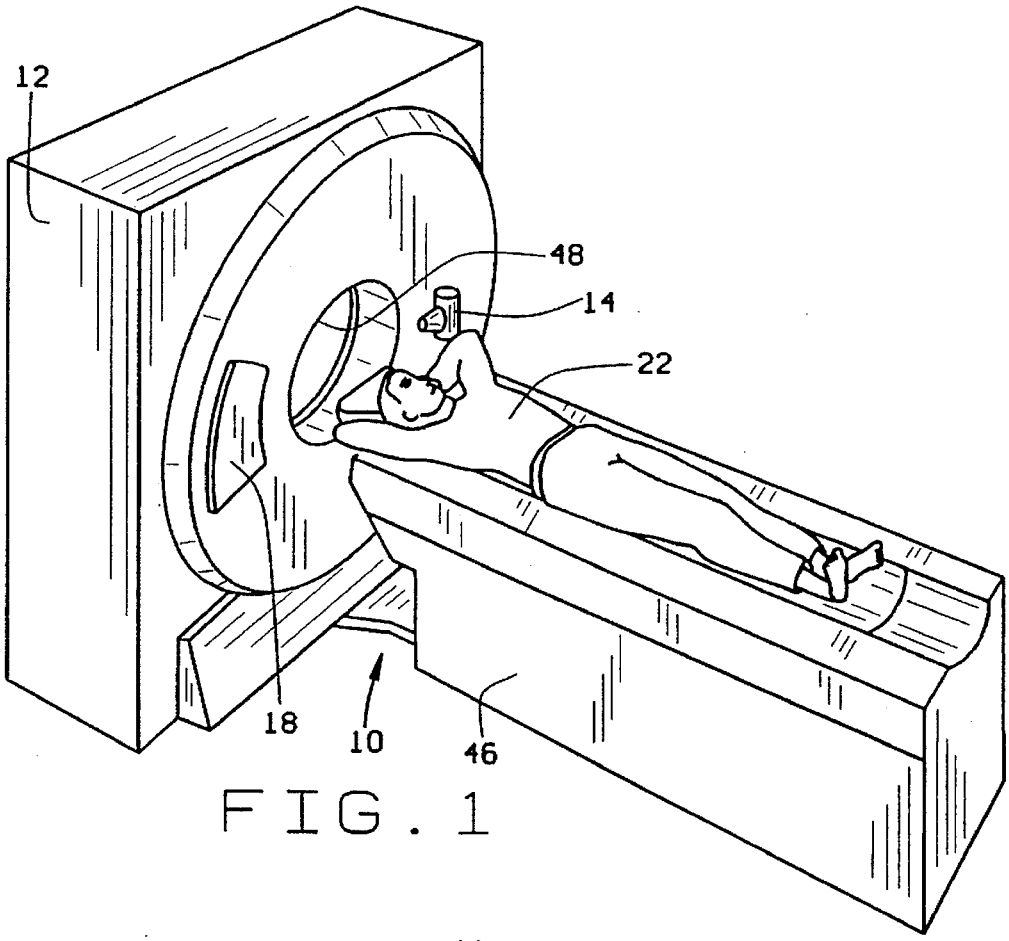
FIG. 1 is a pictorial view of a CT imaging system.
Figure 2:
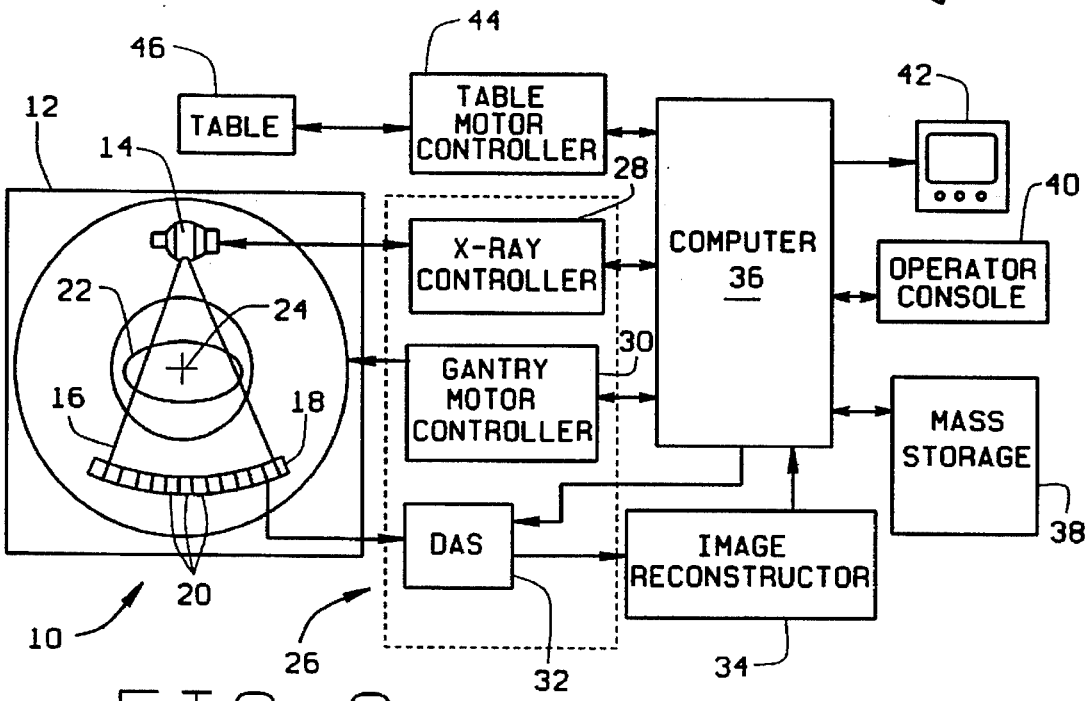
FIG. 2 is a block schematic diagram of the system illustrated in FIG. 1.

Referring to FIGS. 1 and 2, a computed tomograph (CT) imaging system 10 is shown as including a gantry 12 representative of a "third generation" CT scanner. Gantry 12 has an x-ray source, or tube 14 that projects a beam of x-rays 16 toward a detector array 18 on the opposite side of gantry 12. Detector array 18 is formed by detector elements 20 which together sense the projected x-rays that pass through a medical patient 22. Each detector element 20 produces an electrical signal that represents the intensity of an impinging x-ray beam and hence the attenuation of the beam as it passes through patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to x-ray source 14 and a gantry motor controller 30 that controls the rotational speed and position of gantry 12. A data acquisition system (DAS) 32 in control mechanism 26 samples analog data from detector elements 20 and converts the data to digital signals for subsequent processing. An image reconstructor 34 receives sampled and digitized x-ray data from DAS 32 and performs high speed image reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 in gantry 12. Particularly, table 46 moves portions of patient 22 through gantry opening 48.

The present x-ray tube current modulation is not directed to any particular image reconstruction algorithm such as backprojection and forward projection algorithms. Rather, the present x-ray tube current modulation may be used in conjunction, albeit during a scan, with such reconstruction algorithms. It should be further understood that the current modulation algorithm would be implemented in computer 36 and would control, for example, x-ray controller 28 to supply a desired current to x-ray tube 14, as shown in FIG. 2.

Figure 3:
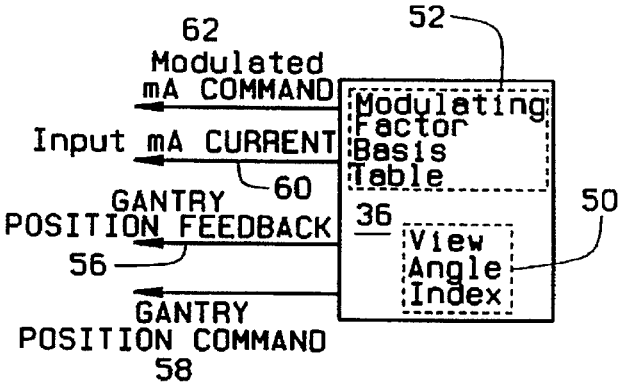
FIG. 3 is a block diagram of the computer system which forms part of the CT system illustrated in FIG. 2.

In accordance with one embodiment of the present invention, and as shown in FIG. 3, a view angle index (i) table 50 is stored in computer 36. Each view angle index corresponds to an mA adjustment factor $F_i$ stored in a modulating factor basis table 52. Alternatively, of course, mA adjustment factors ($F_i$) need not be stored in computer 36. Rather, computer 36 may, during the scan, determine mA adjustment factors ($F_i$) in "real time" for each new angle.

Computer 36 is coupled to gantry motor controller 30 (FIG. 1) and receives, via input 56, gantry position feedback from controller 30. Computer 36 supplies controller 30 with gantry position commands, via output 58. Computer 36 also is coupled to x-ray controller 28 (FIG. 1) and receives a signal representative of x-ray tube current via input 60 and outputs a modulation command to controller 28 via output 62.

As one specific example, if USW or HW is to be applied to projection data during reconstruction, and the weight accorded to each view (i) is $w_i$ and the mA adjustment factor for each view ($F_i$), or modulating factor is:

$F_i = w_i/2.0$ for: $2 \cdot \min < w_i < 2.0$, otherwise $F_i = \min$, where:

$F_i$ is the normalized view dependent mA adjustment factor;

i is the view angle index;

$w_i$ is the weighting coefficient, applied pursuant to, for example, USW for a central ray in view$_i$ and where: $0 < w_i < 2.0$; and min=0.44 is the minimum desired mA adjustment factor.

The weighting coefficient ($w_i$) for a central ray in the view (i) is used because the central region of the image is generally the most important view.

Figure 4:
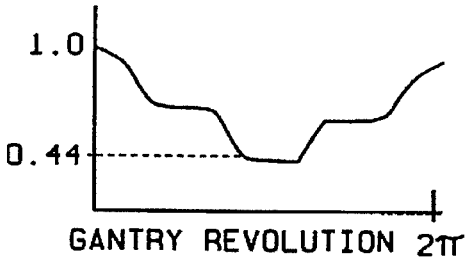
FIG. 4 is a graphic representation of a current modulation profile during one revolution of the system illustrated in FIG. 1.

Referring to FIG. 4, curve 54 illustrates how modulating factors ($F_i$) modulate x-ray tube current with respect to gantry angle for corresponding USW weighting coefficients. Modulating factors ($F_i$) modulate the x-ray tube current and have values from and between a minimum (0.44) to a maximum (1.0). For example, if the prescribed tube current is 100 mA, then the modulated tube current would have values from 100 mA to 44 mA.

To achieve such modulation, computer 36 outputs a mA adjustment factor ($F_i$) command, via output 62, for each view angle in index (i). Accordingly, the x-ray tube current (mA) is modulated during each slice acquisition as a function of gantry angle according to the weighting to be applied to views during reconstruction, for example, by USW or HW. During one complete gantry rotation, the tube current (mA) is thus modulated using modulating factors ($F_i$).

Figure 5:
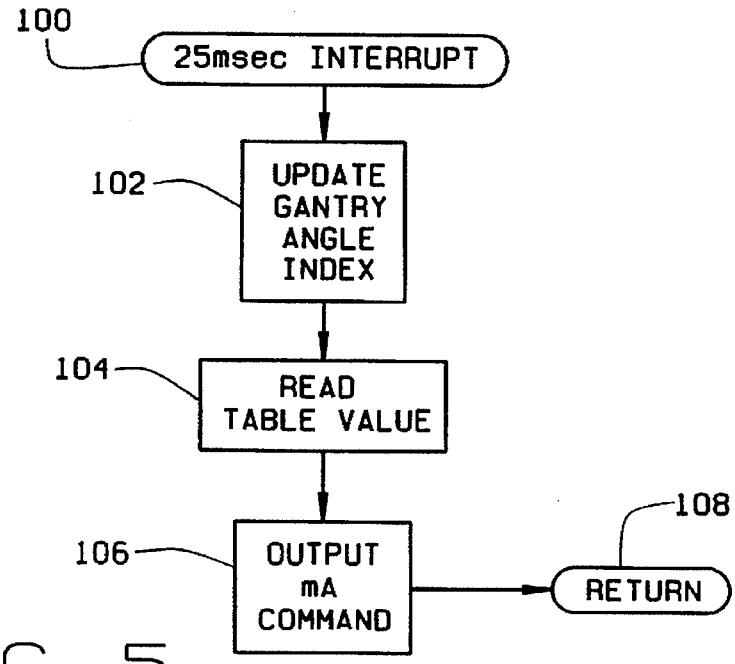
FIG. 5 is a flow chart of a sequence of process steps executed by the computer system illustrated in FIG. 3 to adjust x-ray tube current.

In one specific form of operation, computer 36 performs these functions under the direction of an interrupt routine illustrated in FIG. 5. The interrupt routine is executed repeatedly during each scan. More specifically, an interrupt 100 is executed every 25 msecs. During each interrupt, the gantry angle index is updated 102 in accordance with the amount of gantry motion during the previous time interval. The updated gantry angle index is then used to identify, or read 104, a value from modulating factor basis table 52. Using the value from table 52, a mA command 106 is output, via output 62, to x-ray controller 28. Processing then returns 108 to executing the 25 msec interrupt 100.

The modulated mA may be determined using the following:

$$mA=F_i*\text{prescribed mA},$$

where mA represents the magnitude of current to be supplied by x-ray controller 28 to x-ray source 14 (FIG. 1 ). The mA command output at step 106 causes controller 28 to supply the desired modulated current to source 14.

Figure 6:
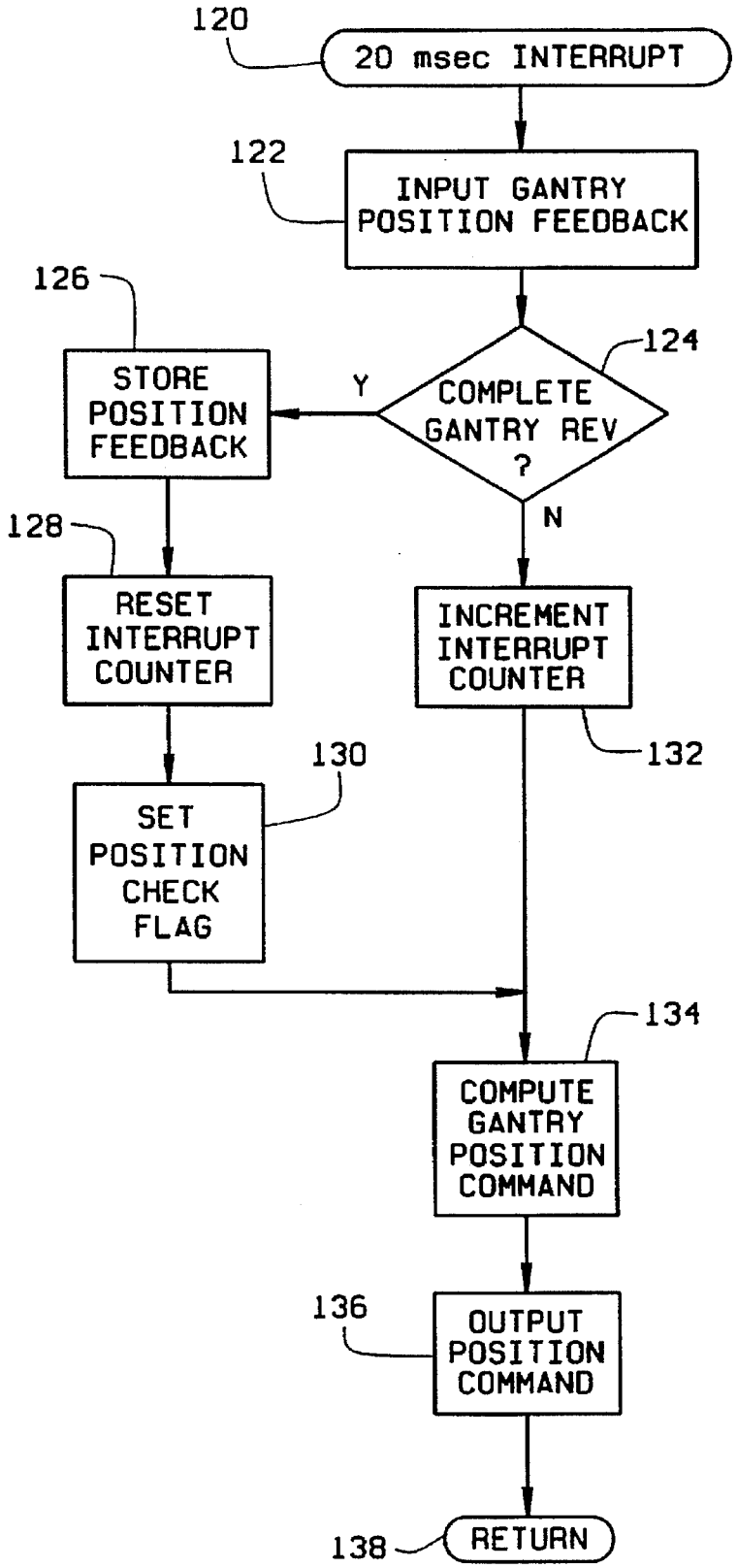
FIG. 6 is another flow chart of a sequence of process steps executed by the computer system illustrated in FIG. 3 for checking gantry position.

Referring specifically to FIG. 6, computer 36 may also execute a 20 msec interrupt routine which controls gantry rotation through the gantry motor controller 30 (FIG. 1). If so, every 20 milliseconds an interrupt 120 is executed and a gantry position feedback signal (via input 56, FIG. 3) 122 is supplied to computer 36. This feedback signal is the accumulated counts from an incremental shaft encoder (not shown) that measures gantry rotation since it was last reset to zero during a reference operation which occurs between scans. At the start of the scan, the gantry feedback position is stored as the "start of scan gantry position". By using the known gantry period and the number of 20 msec interrupts for one revolution, a complete gantry revolution can be detected by counting the interrupts. This event is detected 124, and when it occurs, the position feedback signal is stored 126, and the 20 msec interrupt counter is reset 128. A position check flag is set 130 to activate a task described below which ensures that the gantry angle index described above closely follows the true gantry angle. If a complete gantry revolution has not occurred 124, then the interrupt counter is incremented 132. A new gantry position command is then calculated at process block 132 and output to the gantry motor controller 30 via output 58. As is well known in the art, the gantry position command is determined using the gantry position feedback signal and the commanded gantry rotation speed selected by the operator to maintain the gantry rotation at a constant rate during the scan. Subsequent to outputting the position command, operations return 138 to the 20 msec interrupt 120.

As indicated above, the position check flag set by the 20 msec interrupt routine activates a task which checks for proper gantry angle indication. As shown, for example in FIG. 7, this task is entered at 140 and the number of rotations completed since the start of scan is incremented 142. Using the updated counter value for gantry rotations, the presumed gantry angle is updated 144. The presumed gantry angle is computed 144 using the following:

$$\text{presumed gantry angle}=\text{start of scan gantry position}+((\text{number of encoder counts per rotation})*(\text{number of rotations completed since the start of scan})) \quad (3)$$

The present gantry position is compared with the presumed gantry position for the completed rotation 146. If the present gantry position deviates from the expected value by more than 15 degrees, then the gantry angle correction is computed 148 and sent to the 25 msec interrupt handler to be used to correct the indexing on the next 25 msec interrupt. The start of scan gantry angle is then reset 150 to the present gantry angle, and the number of rotations completed since start of scan is cleared. If the present gantry position does not deviate more than 15 degrees, then no correction is sent to the 25 msec interrupt handler. The gantry angle correction is the number of 0.25 degree counts necessary to bring the gantry angle index into alignment with the gantry position feedback signal, and it will have an affect when the next 25 millisecond interrupt occurs to calculate a new mA command.

Figure 7:
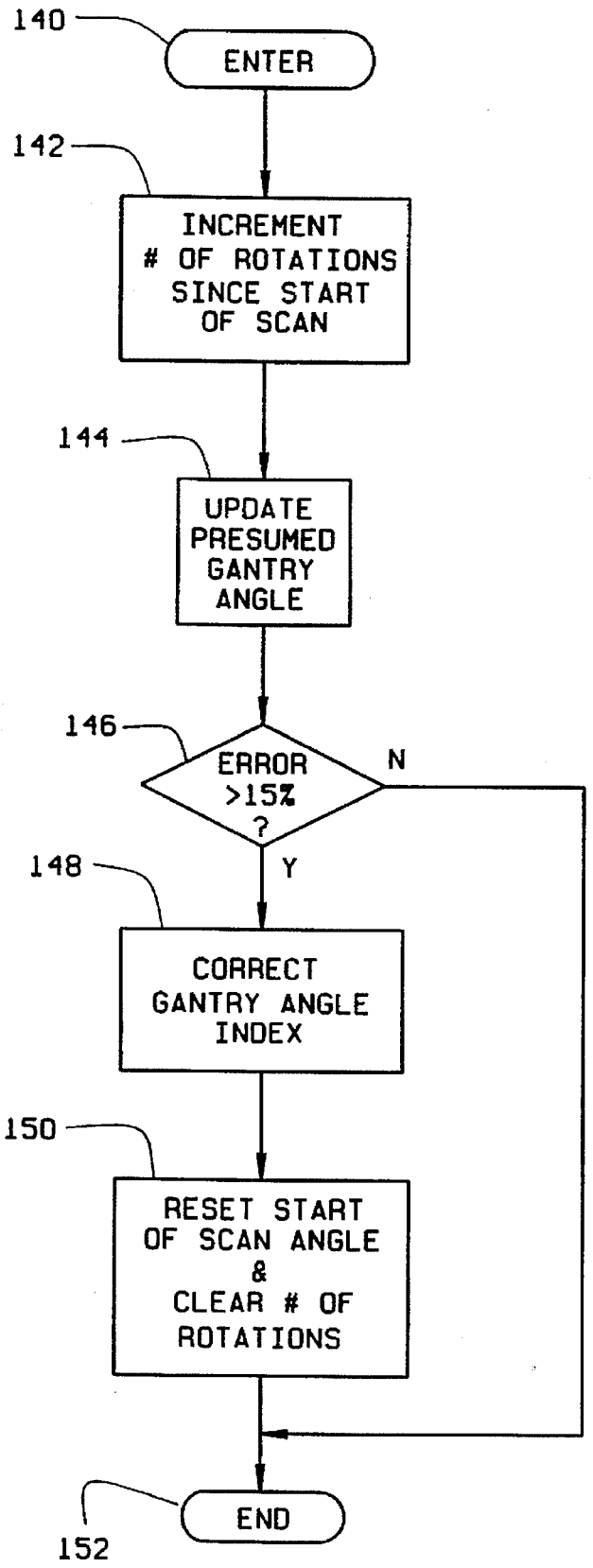
FIG. 7 is another flow chart of a sequence of process steps executed by the computer system illustrated in FIG. 3 for correcting for any possible gantry angle error associated with adjusting x-ray tube current.

Further details regarding certain operational aspects of computer 36 and the routines illustrated in FIGS. 5, 6 and 7 are set forth in U.S. patent application Ser. No. 08/285,253, filed Aug. 3, 1994, entitled "Modulation of X-Ray Tube Current During CT Scanning", now U.S. Pat. No. 5,485,494, which is assigned to the present assignee and incorporated herein, in its entirety, by reference.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, the CT system described herein is a "third generation" system in which both the x-ray source and detector rotate with the gantry. Many other CT systems including "fourth generation" systems wherein the detector is a full-ring stationary detector and only the x-ray source rotates with the gantry, may be used. Moreover, the mA adjustment factor may be determined with respect to reconstruction algorithms other than USW and HW. Similarly, the minimum adjustment factor can be other than 0.44. Accordingly, the spirit and scope of the invention are to be limited only by the terms of the appended claims.

What is claimed is:

1. A method for modulating x-ray tube current supplied to an x-ray source of a computed tomography system, the system using attenuation data to reconstruct an image of an object scanned by the system, the image reconstruction process assigning weights to at least some of the data, said method comprising the steps of:

determining a gantry angle;

identifying an x-ray tube current modulating factor based on the determined gantry angle and the weighting to be assigned to the data collected at that gantry angle; and modulating the x-ray tube current using the identified x-ray tube current modulating factor.

2. A method in accordance with claim 1 wherein the normalized mA modulating factor $F_i$ is:

for: $F_i=w_i</2.0$, for: $2\cdot\min<w_i\leqq 2.0$, otherwise $F_i=\min$, where:

i is a view angle index;

$w_i$ is the weighting coefficient for a central ray in view$_i$ and where $0<w_i<2.0$; and min is a minimum mA modulating factor.

3. A method in accordance with claim 2 wherein the minimum modulating factor is 0.44.

4. A method in accordance with claim 2 wherein modulating the x-ray tube current comprises multiplying the x-ray tube current with the modulating factor and outputting that product to an x-ray controller.

5. A method in accordance with claim 4 wherein the system includes a computer having a memory, and said method further comprises the step of storing the view angle index in the computer memory, the view angle index corresponding to a system gantry angle.

6. A method in accordance with claim 5 further comprising the step of storing the modulating factor in the computer memory, the modulating factor corresponding to the view angle index.

7. A method in accordance with claim 6 further comprising the step of storing a modulating factor basis table in the computer memory, the table comprising stored modulating factors.

8. A method in accordance with claim 1 wherein the weighting to be assigned to the data collected at that gantry angle is underscan weighting.

9. A method in accordance with claim 1 wherein the weighting to be assigned to the data collected at that gantry angle is helical weighting.

10. Apparatus for modulating x-ray tube current supplied to an x-ray source of an imaging system, the x-ray source mounted to a gantry to scan an object of interest, the system using attenuation data acquired by the scan to reconstruct an image of the object, the image reconstruction process assigning weights to at least some of the data, said apparatus comprising a processor programmed to:

determine a gantry angle;

identify an x-ray tube current modulating factor based on the determined gantry angle and the weight to be assigned to the data collected at that gantry angle; and modulate the x-ray tube current using the identified x-ray tube current modulating factor.

11. Apparatus in accordance with claim 10 wherein to modulate x-ray tube current, said processor is programmed to multiply the x-ray tube current by the x-ray tube current modulating factor, and output the product to a system x-ray controller.

12. Apparatus in accordance with claim 11 wherein the normalized mA modulating factor is $F_i$ is:

$F_i = w_i/2.0$ for: $2 \cdot \min < w_i \leqq 2.0$, otherwise $F_i = \min$, where:

$F_1$ is the modulating factor;

i is the view angle index;

$w_i$ is the weighting coefficient for a central ray in $\text{view}_i$ and where $0 < w_i < 2.0$; and min is a minimum modulating factor.

13. Apparatus in accordance with claim 12 wherein the minimum modulating factor is 0.44.

14. Apparatus in accordance with claim 12 further comprising a memory, said processor coupled to said memory and programmed to store the view angle index in said memory.

15. Apparatus in accordance with claim 14 wherein said processor is programmed to store a modulating factor in said memory, the modulating factor corresponding to the view index.

16. Apparatus in accordance with claim 10 wherein the weight to be assigned to the data collected at that gantry angle is assigned in accordance with underscan weighting.

17. Apparatus in accordance with claim 10 wherein the weight to be assigned to the data collected at that gantry angle is assigned in accordance with helical weighting.

* * * * *